US010376730B2

(12) United States Patent
Cei et al.

(10) Patent No.: US 10,376,730 B2
(45) Date of Patent: Aug. 13, 2019

(54) ROWING MACHINE

(71) Applicant: TECHNOGYM S.P.A., Cesena (IT)

(72) Inventors: Daniele Cei, Cesena (IT); Luca Benini, Cesena (IT)

(73) Assignee: TECHNOGYM S.P.A., Cesena, FC (IT)

( * ) Notice: Subject to any disclaimer, the term of this patent is extended or adjusted under 35 U.S.C. 154(b) by 110 days.

(21) Appl. No.: 15/586,992

(22) Filed: May 4, 2017

(65) Prior Publication Data

US 2017/0319889 A1 Nov. 9, 2017

(30) Foreign Application Priority Data

May 5, 2016 (IT) ..... 10 2016 046127

(51) Int. Cl.
*A63B 21/00* (2006.01)
*A63B 21/22* (2006.01)
(Continued)

(52) U.S. Cl.
CPC .... *A63B 21/00072* (2013.01); *A63B 21/0051* (2013.01); *A63B 21/0052* (2013.01); *A63B 21/0056* (2013.01); *A63B 21/0088* (2013.01); *A63B 21/151* (2013.01); *A63B 21/225* (2013.01); *A63B 21/4035* (2015.10); *A63B 21/4045* (2015.10); *A63B 22/0076* (2013.01);
(Continued)

(58) Field of Classification Search
CPC ..... A63B 21/00072; A63B 21/4035; A63B 21/0056; A63B 21/0051; A63B 21/151; A63B 21/4045; A63B 21/0088; A63B 21/0052; A63B 71/0619; A63B 21/225; A63B 22/0076; A63B 2022/0079; A63B 21/154
See application file for complete search history.

(56) References Cited

U.S. PATENT DOCUMENTS 4,114,875 A * 9/1978 Deluty ..... A63B 21/018 188/65.1
4,557,480 A * 12/1985 Dudley ..... A63B 21/018 482/120
(Continued)

FOREIGN PATENT DOCUMENTS

WO WO 2007/015096 A2 2/2007
WO WO 2012/053259 A1 4/2012

OTHER PUBLICATIONS

Italian Search Report and Written Opinion issued in Italian Patent Application No. UA20163168 dated Dec. 13, 2016.

*Primary Examiner* — Garrett K Atkinson
(74) *Attorney, Agent, or Firm* — Arent Fox LLP

(57) ABSTRACT

The present invention concerns an improved rowing machine, for the execution of gymnastic exercises similar to strokes and the like, comprising actuating means movable between a rest position and a working position, and a first braking device, operatively connected to said actuating means configured to brake the motion of said actuating means during the passage from said rest position to said working position, characterized in that said rowing machine comprises a second braking device operatively connected to said actuating means, said second braking device being configured to brake the motion of said actuating means during the passage from said rest position to said working position.

14 Claims, 11 Drawing Sheets

(51) Int. Cl.

| | |
|---|---|
| ***A63B 22/00*** | (2006.01) |
| ***A63B 71/06*** | (2006.01) |
| ***A63B 21/005*** | (2006.01) |
| ***A63B 21/008*** | (2006.01) |

(52) U.S. Cl.
CPC ..... *A63B 71/0619* (2013.01); *A63B 21/154* (2013.01); *A63B 2022/0079* (2013.01)

(56) References Cited

U.S. PATENT DOCUMENTS 4,714,244 A * 12/1987 Kolomayets ..... A63B 21/153 482/120
4,743,011 A * 5/1988 Coffey ..... A63B 21/0088 482/111
4,798,378 A * 1/1989 Jones ..... A63B 21/0052 482/72
4,880,224 A * 11/1989 Jonas ..... A63B 21/153 482/72
5,013,033 A * 5/1991 Watterson ..... A63B 22/0076 482/127
5,072,929 A * 12/1991 Peterson ..... A63B 22/0076 310/105
5,496,236 A * 3/1996 Buonauito ..... A63B 21/0603 482/110
5,779,600 A * 7/1998 Pape ..... A63B 22/0076 482/119
6,328,677 B1 * 12/2001 Drapeau ..... A63B 22/0076 482/55
7,572,211 B2 * 8/2009 Roach ..... A63B 22/0076 482/51
8,070,657 B2 * 12/2011 Loach ..... A63B 21/15 482/127
9,662,534 B1 * 5/2017 Liu ..... A63B 22/0076
9,776,038 B1 * 10/2017 Chuang ..... A63B 21/153
9,878,200 B2 * 1/2018 Edmondson ..... A63B 22/0076
2009/0181832 A1 7/2009 Bell

* cited by examiner

ROWING MACHINE

CROSS-REFERENCE TO RELATED APPLICATION

This application claims priority to Italian Patent Application No. 102016000046127, filed May 5, 2016. The disclosure of the priority application is hereby incorporated in its entirety by reference.

The present invention relates to an improved rowing machine.

More specifically, the invention concerns an improved rowing machine of the mentioned type, studied and realized in particular to allow a user to increase the training intensity.

In the following, the description will be directed to an improved air rowing machine, but it is clear that the same should not be considered limited to this specific kind of rower.

As is well known, the rower, also known as a remoergometer or rowing ergometer, is a training machine that allows a user to perform a training simulating a stroke, reproducing the movements that a rower performs.

By the rowing machine, therefore, it is possible to carry out a specific training even during the winter, where watercourses are often not feasible.

The rower substantially comprises an elongated frame having a back and a front part. A track is arranged above the frame, on which a seat is slidingly coupled.

Said rowing machine also comprises a transmission mechanism and an air brake, generally installed on the front side of said frame. Said transmission mechanism comprises a handlebar and transmission members connected with said brake. In this way, the user, pulling the handlebar and acting with his legs, slides said seat and activates the air brake, simulating a stroke.

The air brake can also be installed at any point on the frame, such as in the rear or the center of the track or above or below the track.

The air brakes generally include a fan, which opposes a resistance, directly proportional to the force employed by the user during the stroke.

Said fan is connected, as said, with said transmission means, such as a chain, a rope or a strap.

Said transmission means pass, in particular, from a first starting stroke position to a second stroke position where the handlebar is pulled by the user.

At the end of the exercise, said transmission means return to the first starting position by means of a return elastic system.

Typically, a stroke is composed of two phases, a first high strength phase, in which the user must move from said front position to the rear position of the frame, gripping the handlebar and pulling the chain, to move said air brake, and a second low-intensity release phase, in which the user returns to said front position and the transmission members are returned by the return elastic system.

Some well-known rowers are also equipped with monitors that display training data such as covered distance, stroke pace, burned calories, average speed, and heart rate of the user.

In current rowing machines, the resistance opposing to the stroke is the one opposite to the air brake, particularly suitable for simulating the stroke in the water.

It is clear that with the rowing machines currently in the market carrying out trainings for increasing the user's power and the strength during the gymnastic exercise is not possible.

In light of the above, it is an object of the present invention providing an improved rowing machine, by which a user can perform the training by increasing the air brake resistance, in order to gradually improve his or her performance.

It is therefore specific object of the present invention an improved rowing machine, for the execution of gymnastic exercises similar to strokes and the like, comprising actuating means movable between a rest position and a working position, and a first braking device, operatively connected to said actuating means configured to brake the motion of said actuating means during the passage from said rest position to said working position, characterized in that said rowing machine comprises a second braking device operatively connected to said actuating means, said second braking device being configured to brake the motion of said actuating means during the passage from said rest position to said working position.

Preferably according to the invention, said first braking device is an air brake comprising a flywheel or the like, capable of generating a braking force to the motion of said actuating means substantially proportional to the speed of rotation of said flywheel, and said second braking device being suitable for generating a braking force capable to reduce the speed of rotation of said flywheel.

Further, according to the invention, said second braking device comprises a disc, rotating following the operation of said actuating means passing from said rest position to said working position, and braking magnetic members, capable to generate a magnetic braking force on said disc.

Still according to the invention, said rowing machine could comprise an elongated frame having a front part and a rear part, said elongated frame comprising a cross member on which a track is arranged, and a support arm, placed in correspondence of said front part, a seat, slidingly coupled to said track, for the seat of a user, so as to slide from said front part to said rear part and vice versa, a shaft arranged on said support arm, and said first braking device comprising a fixing plate, for the fixing to said shaft.

Always according to the invention, said second braking device could be integral with said flywheel.

Preferably according to the invention, said shaft could have a first and a second end, said first braking device being coupled to said first end of said shaft and said second braking device being coupled to said second end of said shaft.

Further according to the invention, said second braking device could comprise an electric machine, such as an electromagnetic brake.

Still according to the invention, said electric machine could be coupled to said fixing plate.

Always according to the invention, said shaft could have a first and a second end, said first braking device being coupled to said first end of said shaft and said second braking device being coupled to said second end of said shaft.

Preferably according to the invention, said rowing machine could comprise a display for the interaction of a user with said rowing machine itself, and said first and second braking device are activated by a user through remote means operable by said display.

Further according to the invention, said rowing machine could comprise adjusting means to adjust said first and second braking device.

Still according to the invention, said adjusting means comprise a first lever connected to said first braking device through transmission means, such as a cable, a belt or the like, or said first lever is arranged on said first braking device to adjust the intensity of the braking force generated by said first braking device, and a second lever connected to said first braking device through transmission means, such as a cable, a belt or the like, or said first lever is arranged on said second braking device to activate said second braking device.

Always according to the invention, said adjusting means comprise a first member, arranged on said elongated frame, connected by transmission means, such as a cable, a belt or the like, to said first braking device, and a second member, arranged on said elongated frame coupled to said first member, connected by transmission means, such as a cable, a belt or the like, to said second braking device.

Preferably according to the invention, said first member is a first lever rotatably coupled with said elongated frame by means of a first pivot and first lever is capable to pass from a first position to a second position rotating according to a direction of rotation, a cavity is formed on the surface of said first lever, said second member being a second lever rotatably coupled with said elongated frame by means of said first pin to pass from a first position to a second position by rotating according to said direction of rotation, said second lever is provided with an elongated end, and said second lever being integral with a second pin arranged in said cavity of said first lever.

Further according to the invention, said first member is a knob arranged on said elongated frame connected through transmission means, such as a cable, a belt or the like, to said first braking device, and said second member is a rotatable element, rotatably coupled with said knob, connected through further transmission means, such as a cable, a belt or the like, to said second braking device.

Still according to the invention, said knob comprises a shoulder rotating from a first position to a second position, said rotatable element being provided with a first abutment surface and a second abutment surface, and in said first position, said shoulder is in contact with said first abutment surface and in said second position said shoulder is in contact with said second abutment surface.

The present invention will be now described, for illustrative but not limitative purposes, according to its preferred embodiments, with particular reference to the figures of the enclosed drawings, wherein.

In the various figures, similar parts will be indicated by the same reference numbers.

Figure 1:
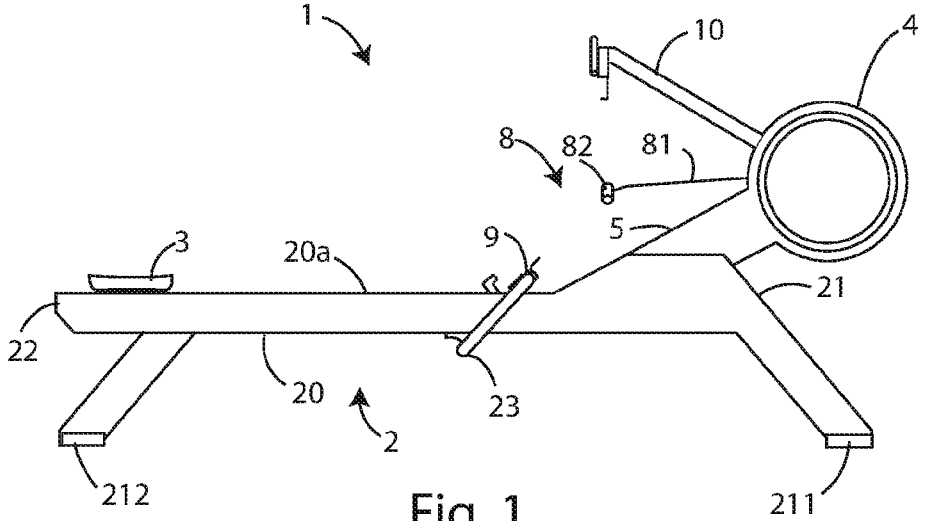
FIG. 1 shows a side view of the improved rowing machine object of the present invention.
Figure 2:
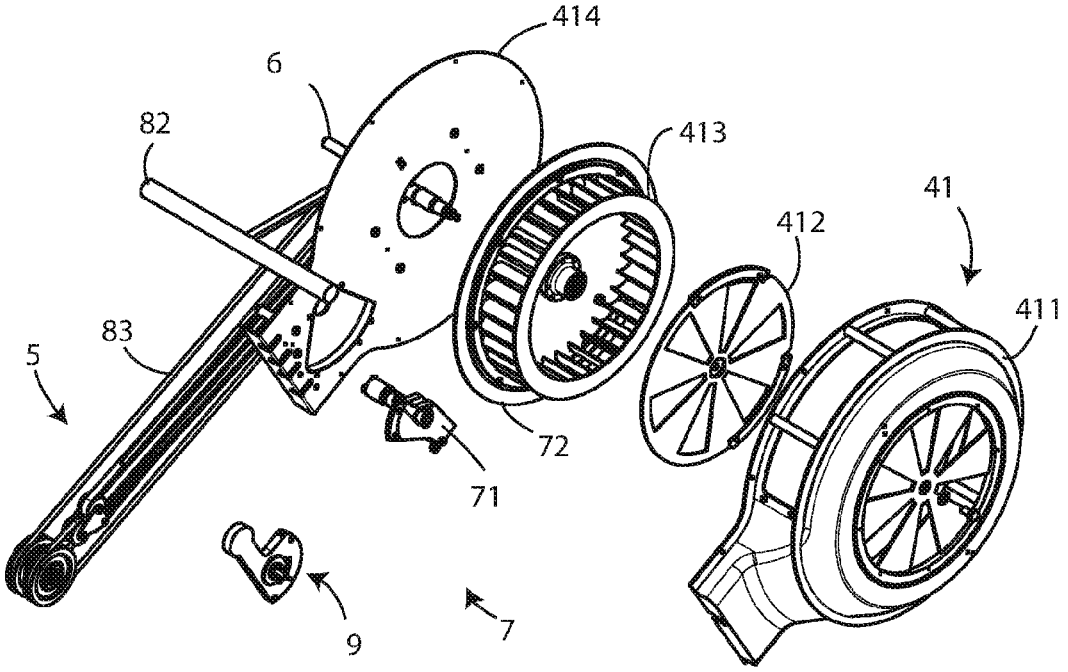
FIG. 2 shows an exploded view of a first embodiment of the front part of the improved rowing machine of FIG. 1.
Figure 3:
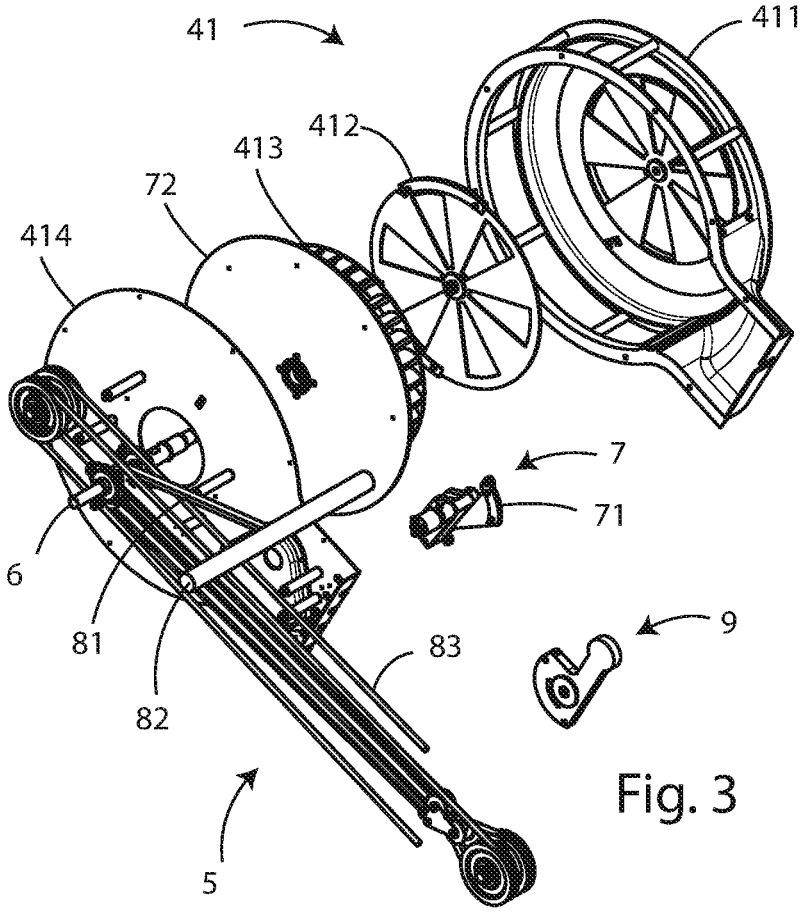
FIG. 3 shows a further exploded view of a first embodiment of the front part of the improved rowing machine.
Figure 4:
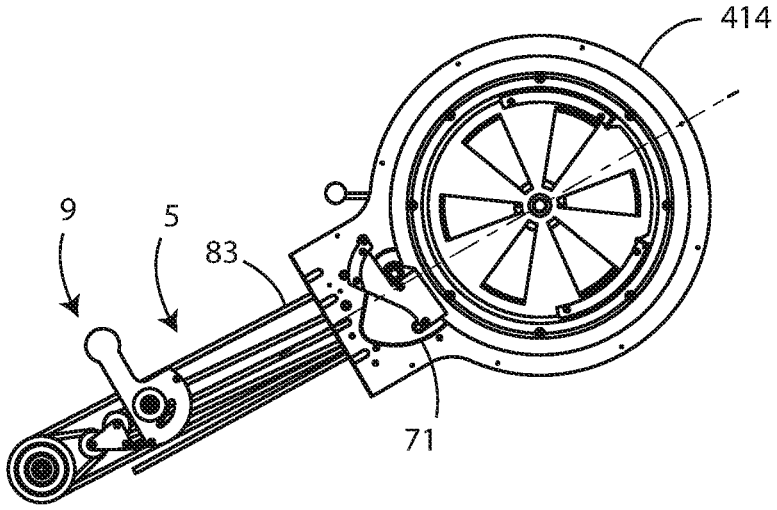
FIG. 4 shows a schematic side view of a first embodiment of the front part of the improved rowing machine.
Figure 5:
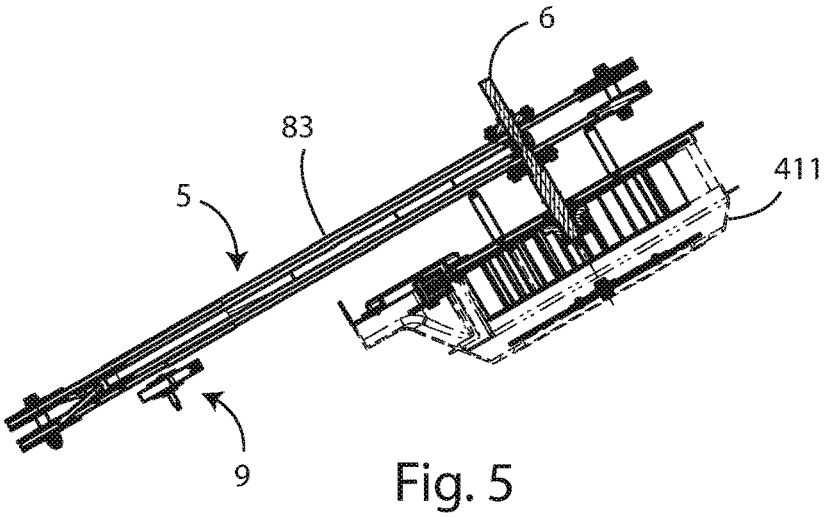
FIG. 5 shows a top view of a first embodiment of the front part of the improved rowing machine.

Referring to FIG. 1, the improved rowing machine 1 object of the present invention comprises an elongated frame 2, which in its turn comprises a cross member 20, provided above a track 20*a*, a seat 3, such as a seat, slidably mounted on said track 20*a*, a first braking device 4 and a second braking device, actuating means 8 of said first and second braking devices and adjusting means 9 of said first 4 and second braking devices.

In particular, said elongated frame 2 is provided with a front part 21 and a rear part 22, opposite to said front part 21.

Said elongated frame 2 is also provided with support feet 211-212 for supporting said cross member 20 on a supporting base, such as the floor.

In correspondence of said front part 21, a pair of footrests 23 are positioned on said cross member 20, for supporting and blocking the feet of said user during the strokes.

In an embodiment of said improved rowing machine 1, said pair of footrests 23 are slidably coupled with said track 20*a*, while said seat 3 is fixed.

Said seat 3 is slidably coupled to said track 20*a* to slide from said front part 21 towards said rear part 22 and vice versa, to allow a user sitting while carrying out the strokes on said improved rower 1.

A hook can be positioned on said seat 3 to engage said actuating means 8, so as to perform further gymnastic exercises, such as leg bends and the like.

As said, in correspondence of said front part 21 of said elongated frame 2 a first braking device 4 is provided, which generates a mechanical resistance to the motion of said user during the strokes.

Said first braking device 4 is mechanically fastened to said elongated frame 2 by means of a support arm 5 supporting a shaft 6, to which said first braking device 4 is rotatably coupled.

Said first braking device 4 is an air brake 41 according to the prior art, particularly suitable for simulating the user's stroke.

Referring now to FIGS. 2-5, said air brake 41 includes a cover 411, provided with inlet and outlet air slots, a wheel 412, for adjusting the airflow through said cover 411, provided with slots that overlap in an adjustable way with said slots of said cover 411.

Said air brake 41 also includes a flywheel 413 coupled with said shaft 6 by means of a free wheel housed inside said cover 411, provided with a plurality of air friction or resistance fins, when said flywheel 413 is rotating.

Said air brake 41 is coupled with said support arm 5 by means of a fixing plate 414, on which the cover 411 is secured.

The wheel 412 is rotatably coupled with said cover 411.

In a first embodiment of said improved rowing machine 1 said second braking device 7 comprises a magnetic brake 71, which acts on a disc 72 made of a material, reactive to the magnetic field generated by said magnetic brake 71 during the rotation of said disc 72.

Said disc 72 is integral with said flywheel 413.

In particular, said magnetic brake 71 comprises a bracket supporting one or more permanent magnets.

Said bracket has an elongated shape and is rotatably coupled with said elongated frame 2 by means of a central pivot P.

A first end of said bracket is constrained to said elongated frame 2 by means of an elastic return spring 73, whose function will be described in detail in the following.

A second end of said bracket is constrained to other members, which will be described in detail in the following.

Figure 6:
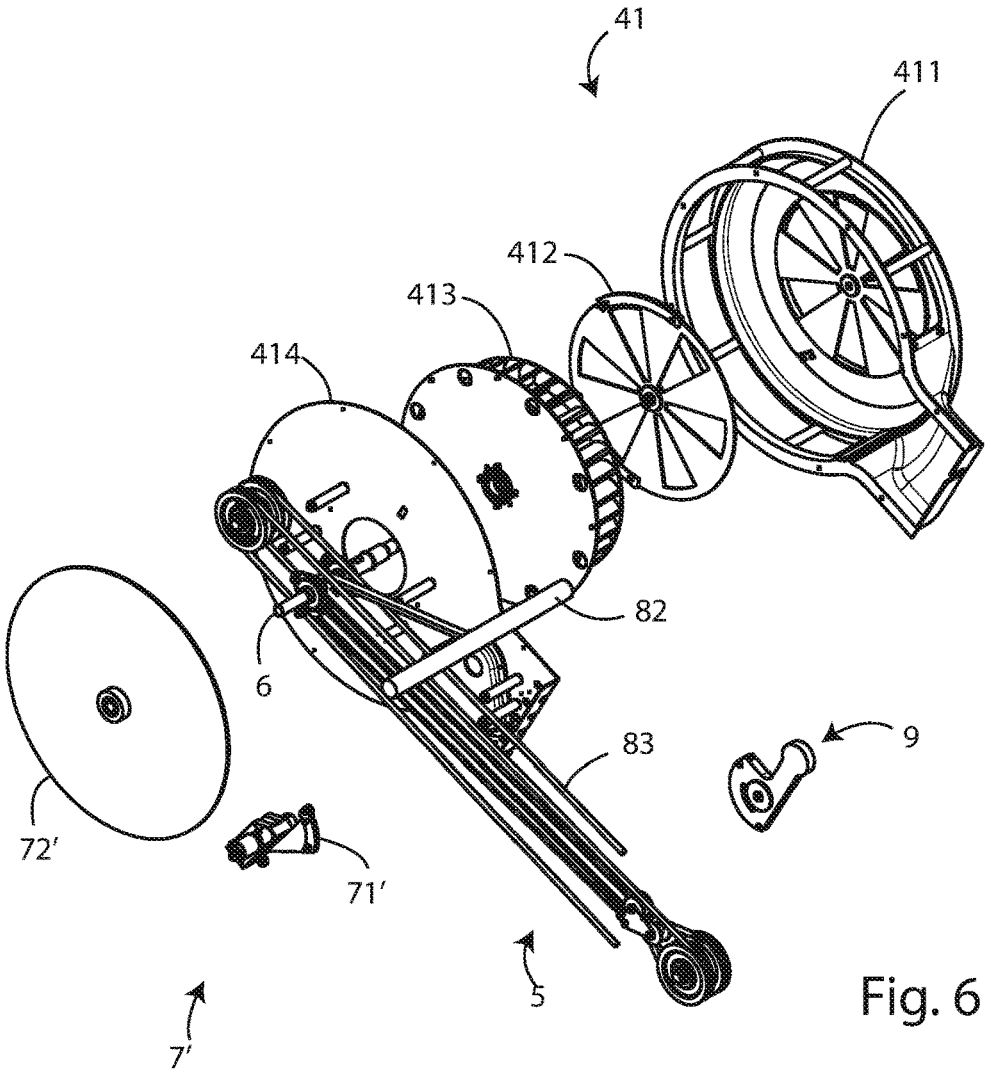
FIG. 6 shows an exploded view of a second embodiment of the front part of the improved rowing machine.
Figure 7:
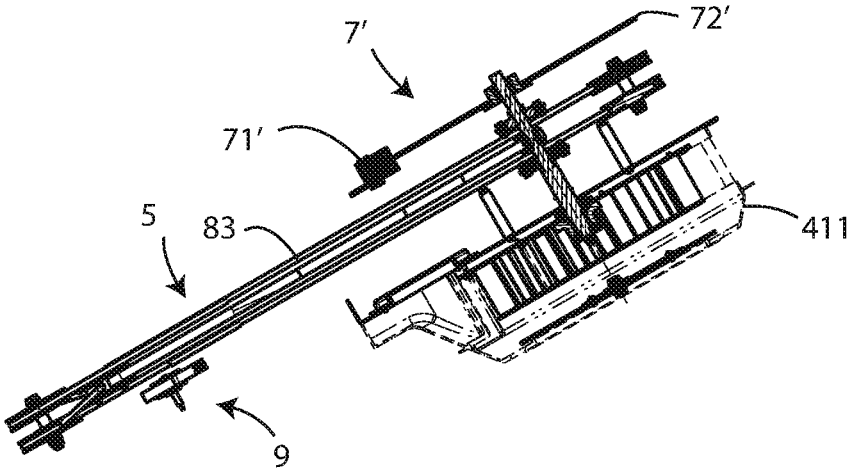
FIG. 7 shows a top view of a second embodiment of the front part of the improved rowing machine.

FIGS. 6-7 show a second embodiment of said second braking device 7', which differs from the above described first embodiment for the position of said second braking device 7'.

Said disc 72' is coupled with the end of said shaft 6, for example by means of a free wheel, opposite with respect to the one said first braking device 4 is coupled with. In addition, said magnetic brake 71' is housed close to said support arm 5.

Figure 8:
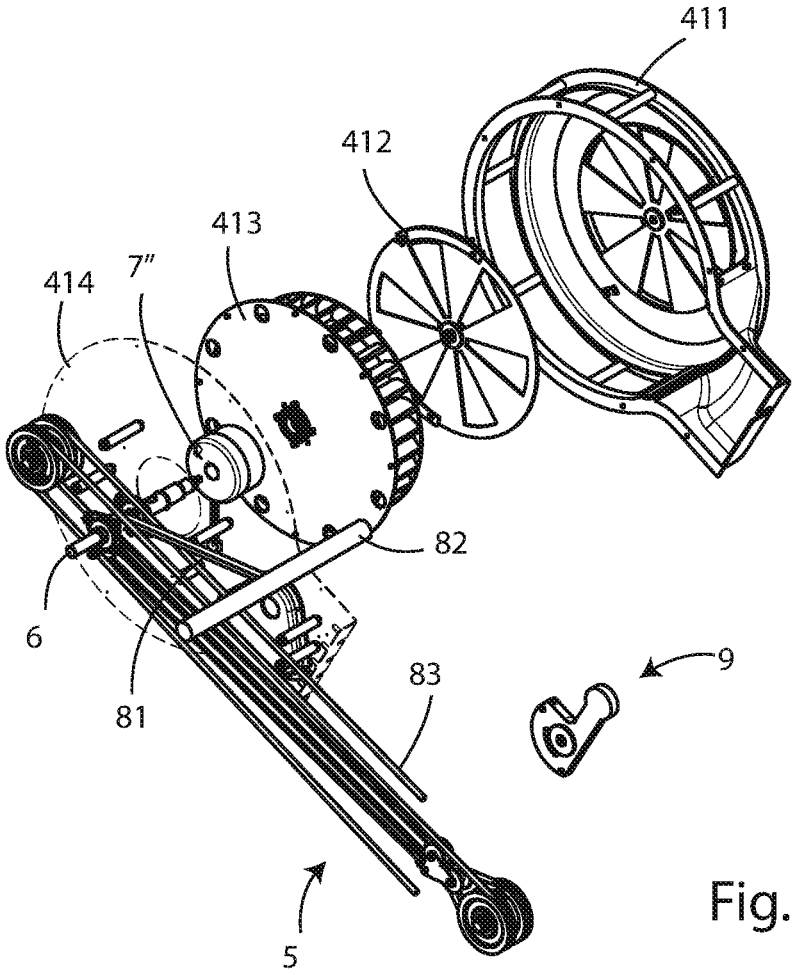
FIG. 8 shows an exploded view of a third embodiment of the front part of the improved rowing machine.
Figure 9:
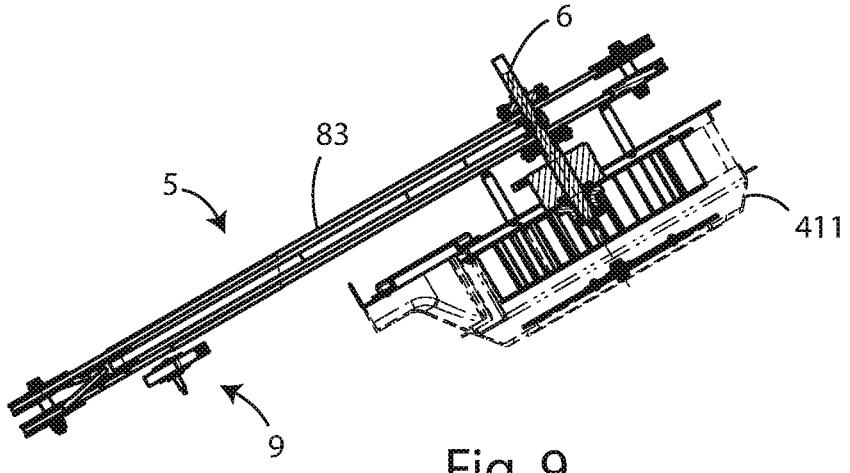
FIG. 9 shows a top view of a third embodiment of the front part of the improved rowing machine.

FIGS. 8 and 9 show a third embodiment of said second braking device 7", which in this case is an electric machine, for example a generator, which exerts a braking action on said shaft 6, in particular it is coupled with said shaft 6 and with said fixing plate 414, so as to increase the resistance of said first braking device 4 during the stroke.

Figure 10:
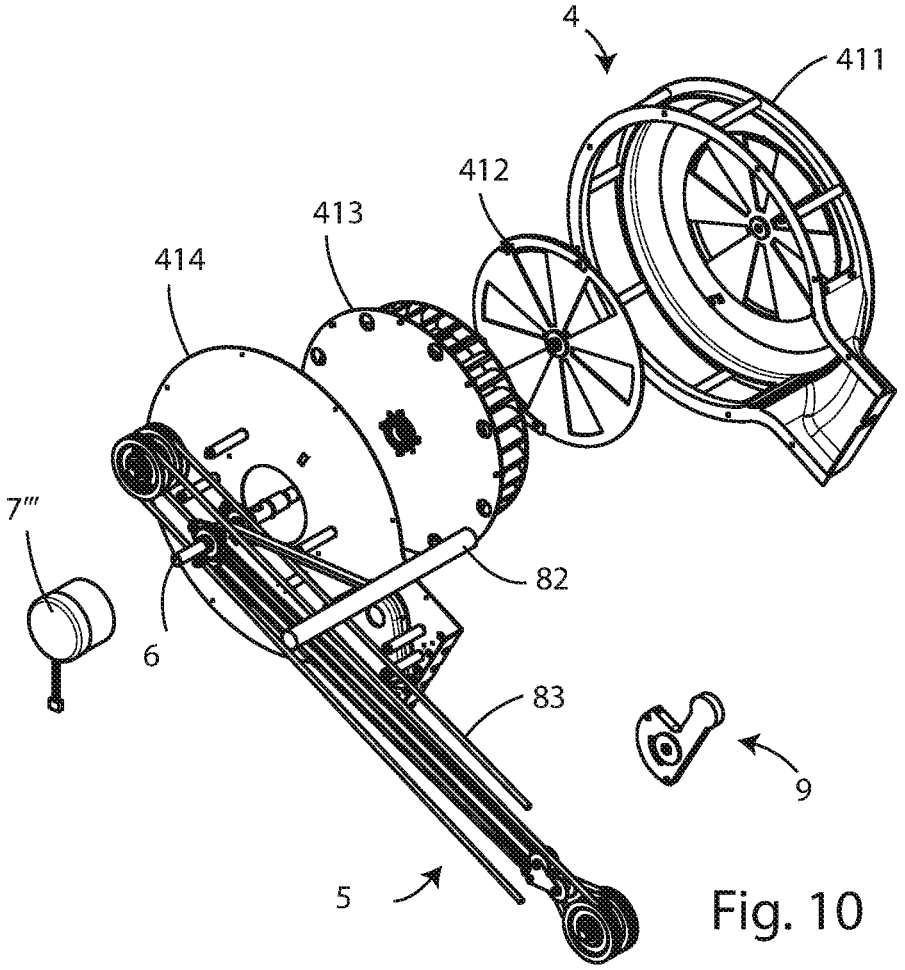
FIG. 10 shows an exploded view of a fourth embodiment of the front part of the improved rowing machine.
Figure 11:
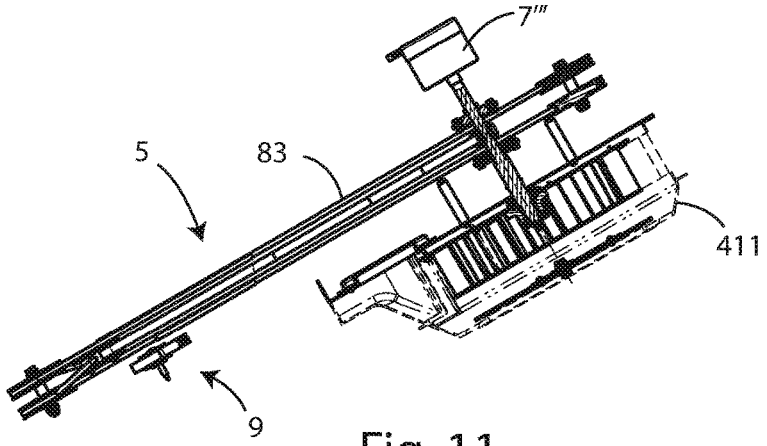
FIG. 11 is a top view of a fourth embodiment of the front part of the improved rowing machine.

FIGS. 10 and 11 show a fourth embodiment of said second braking device 7'", which differs from the third embodiment described above in that said electric machine 7'" is freewheel coupled with the end of said shaft 6 opposite to the end said first braking device 4 is coupled with.

Said first 4 and second 7, 7', 7" or 7'" braking devices are actuated by said user during the strokes by actuating means 8.

Said actuating means 8 comprise a chain 81 or rope or belt, connected at a first end to a handlebar 82, which is gripped by said user, and at a second end to an elastic returning system 83 contained within said support arm 5.

Said chain 81 is operably connected with said shaft 6 and passes from a start or rest position, in which said handlebar 82 is gripped by said user to start the stroke, to an end stroke or work position, where it is pulled by said user at the end of the stroke.

In a fifth embodiment of said braking device 7, not shown in the figure, said braking device is a magnetic flow generator powered, for example, by an electric winding.

The adjustment of said braking device takes place by adjusting the intensity of the electric current passing through said electric winding.

Said improved rowing machine 1 comprises adjusting means 9 of said first and second braking devices 7, 7', 7", 7'", housed on said elongated frame 2.

Figure 12:
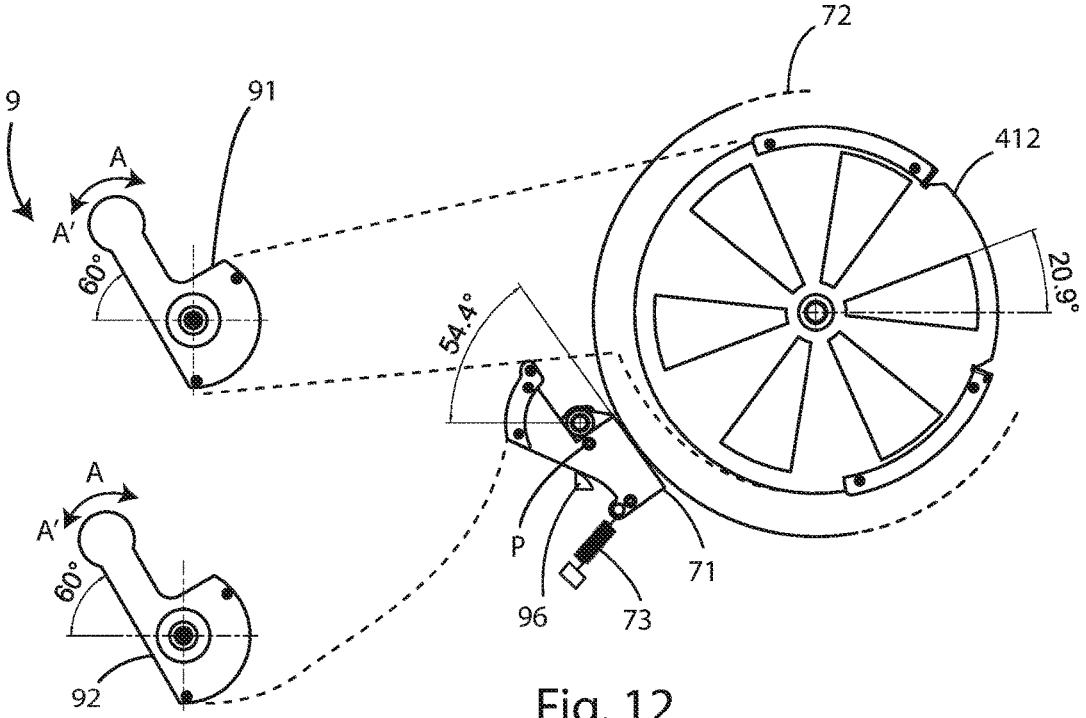
FIG. 12 shows a schematic side view of a first embodiment of the control device, in a first control position of the improved rowing machine.
Figure 13:
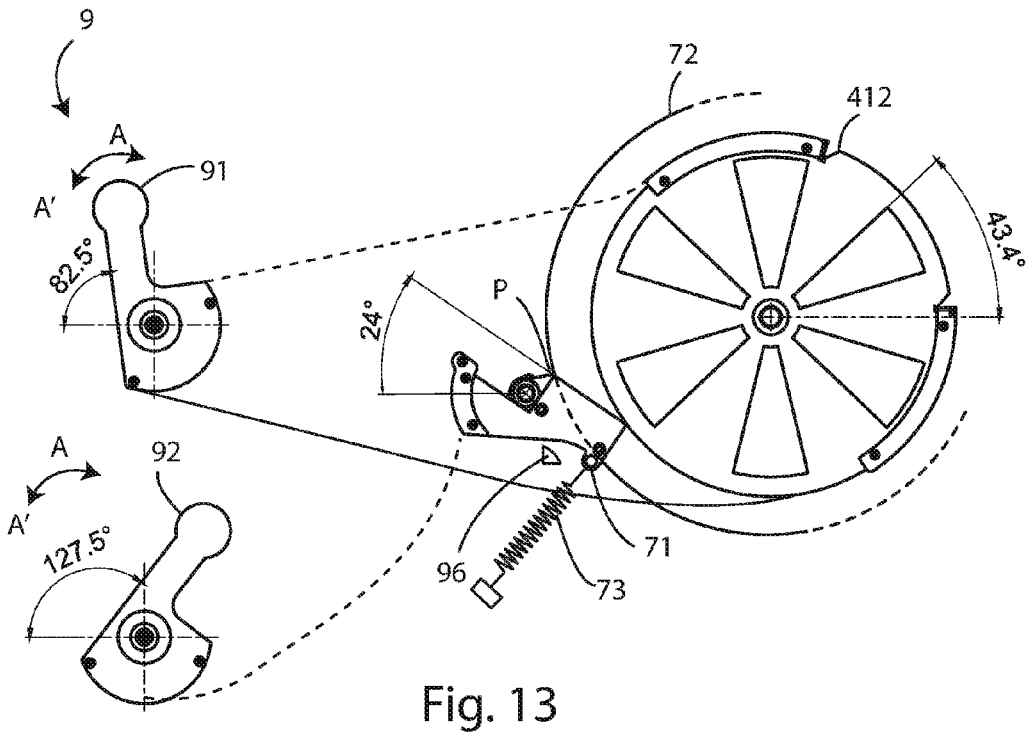
FIG. 13 shows a side schematic view of a first embodiment of the control device, in a further control position of the improved rowing machine.
Figure 14:
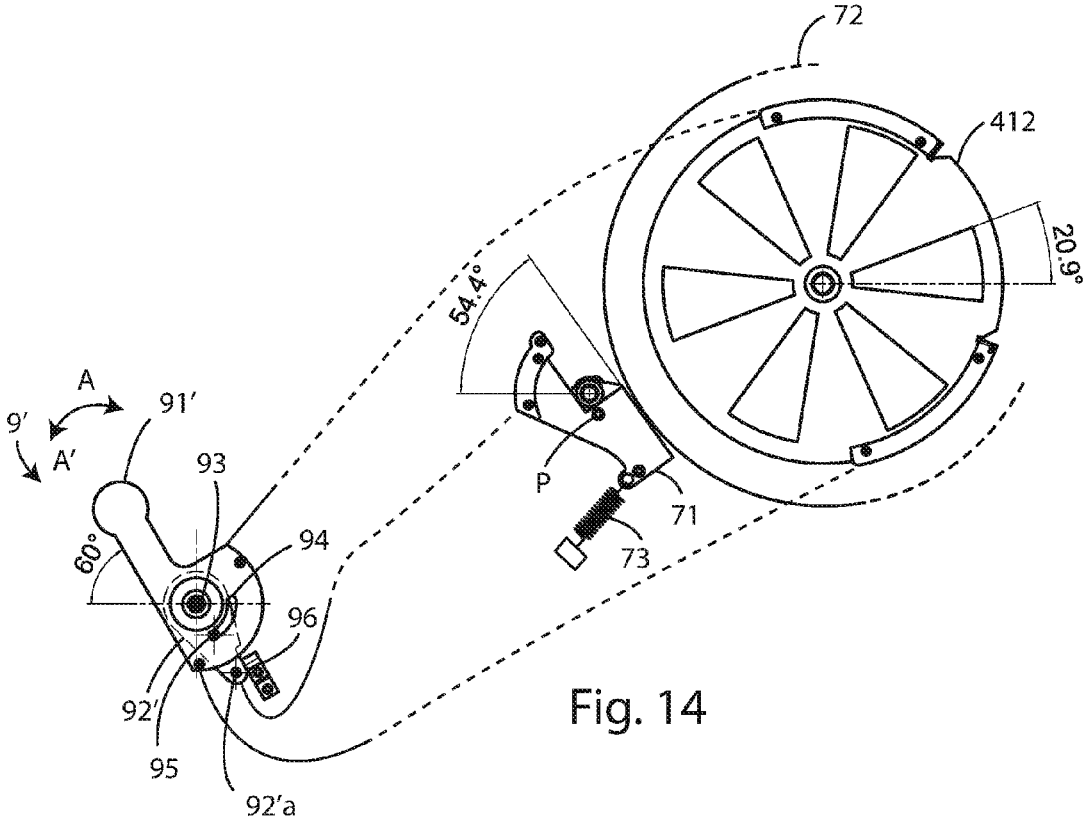
FIG. 14 shows a side schematic view of a second embodiment of the control device, in a first control position of the improved rowing machine.
Figure 15:
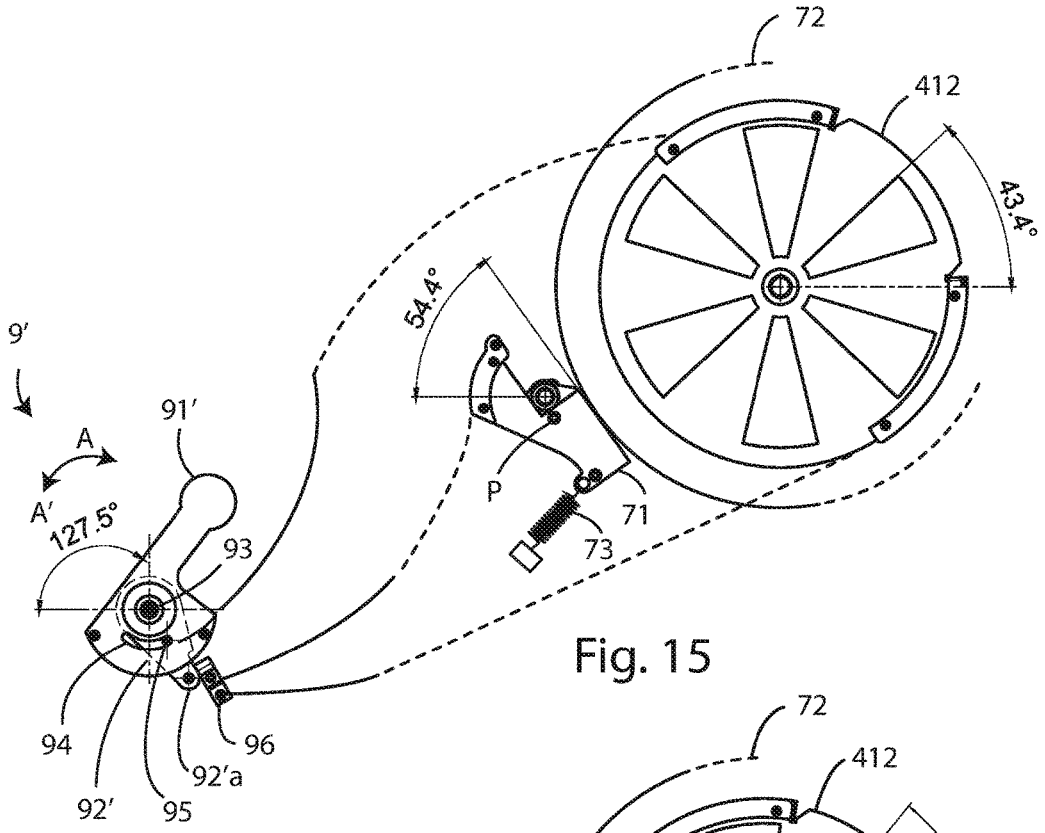
FIG. 15 shows a schematic side view of a second embodiment of the control device in a second control position of the improved rowing machine.
Figure 16:
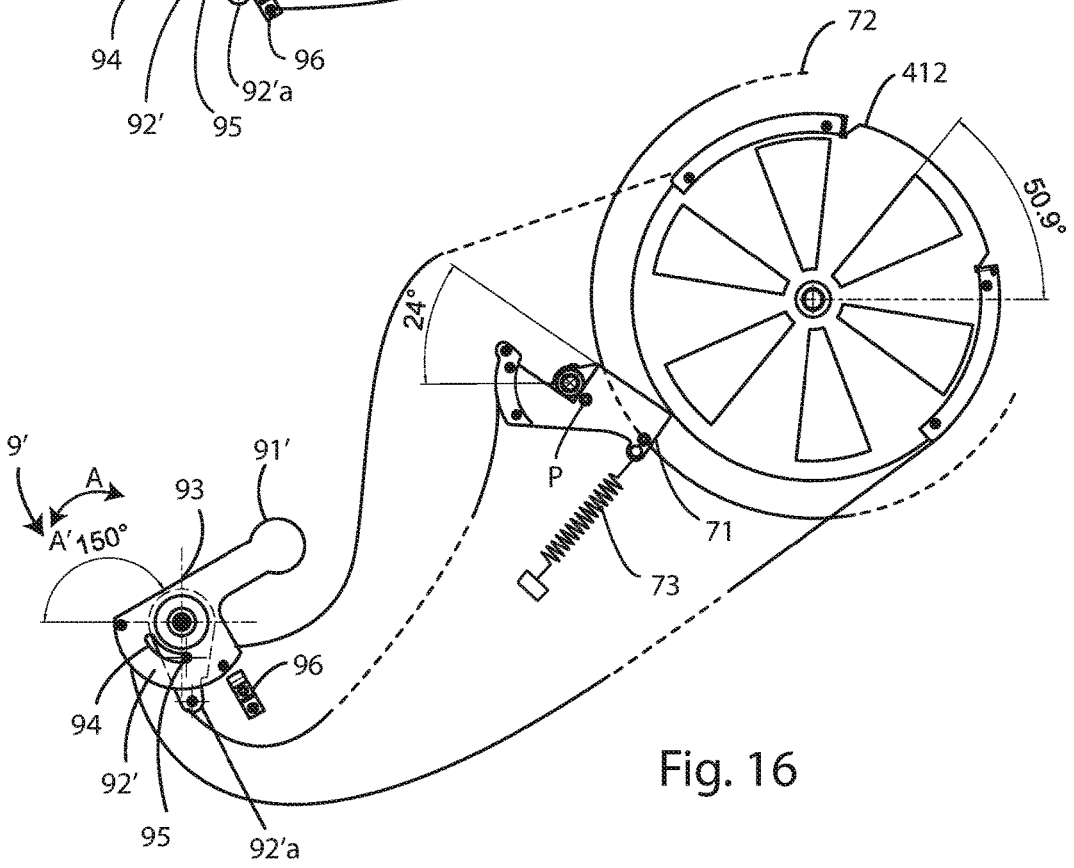
FIG. 16 shows a schematic side view of a second embodiment of the control device in a third control position of the improved rowing machine.
Figure 17:
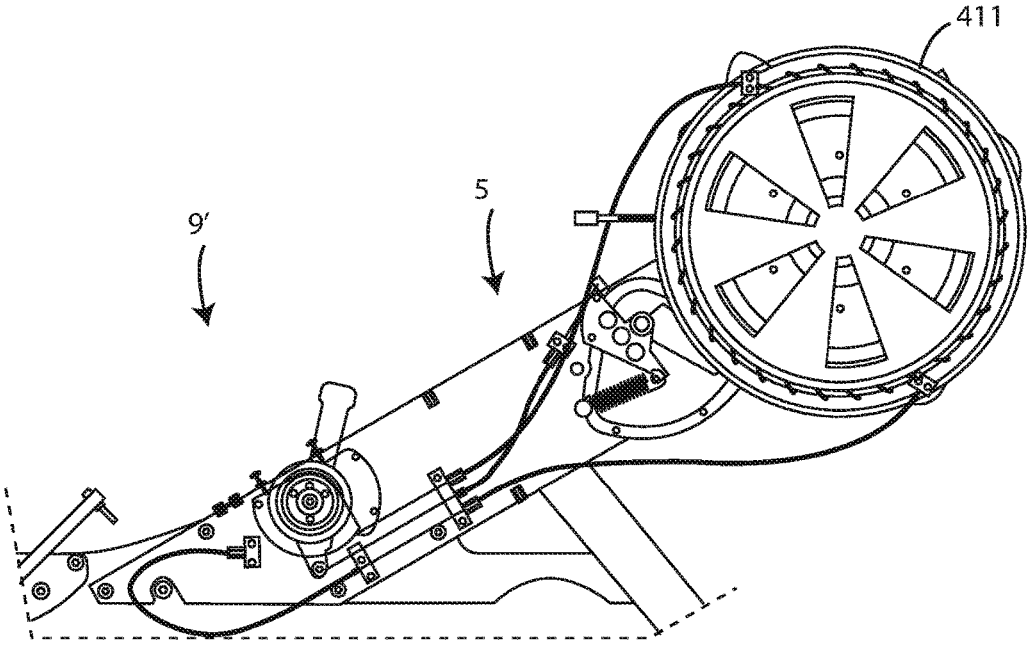
FIG. 17 shows a whole side view of the second embodiment of the control device of the improved rowing machine.
Figure 18:
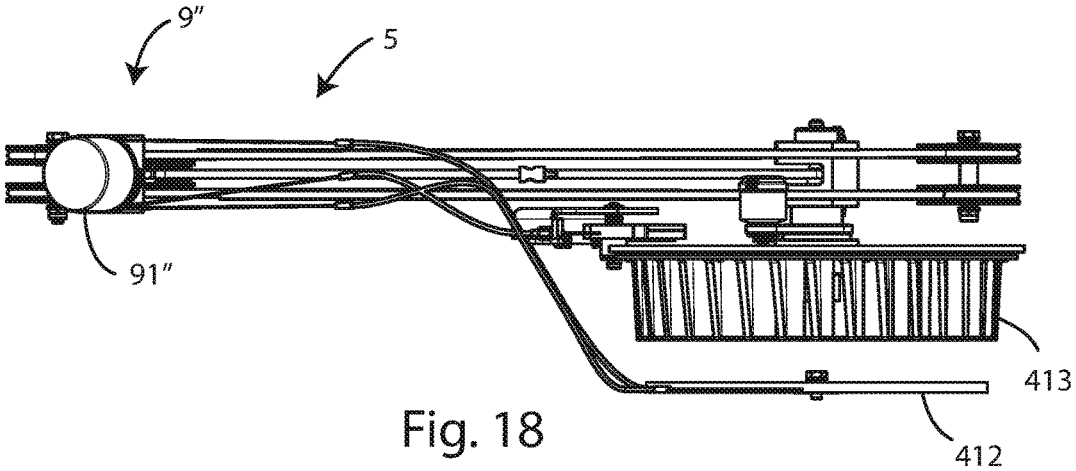
FIG. 18 shows a whole top view of a third embodiment of the control device of the improved rowing machine.
Figure 19:
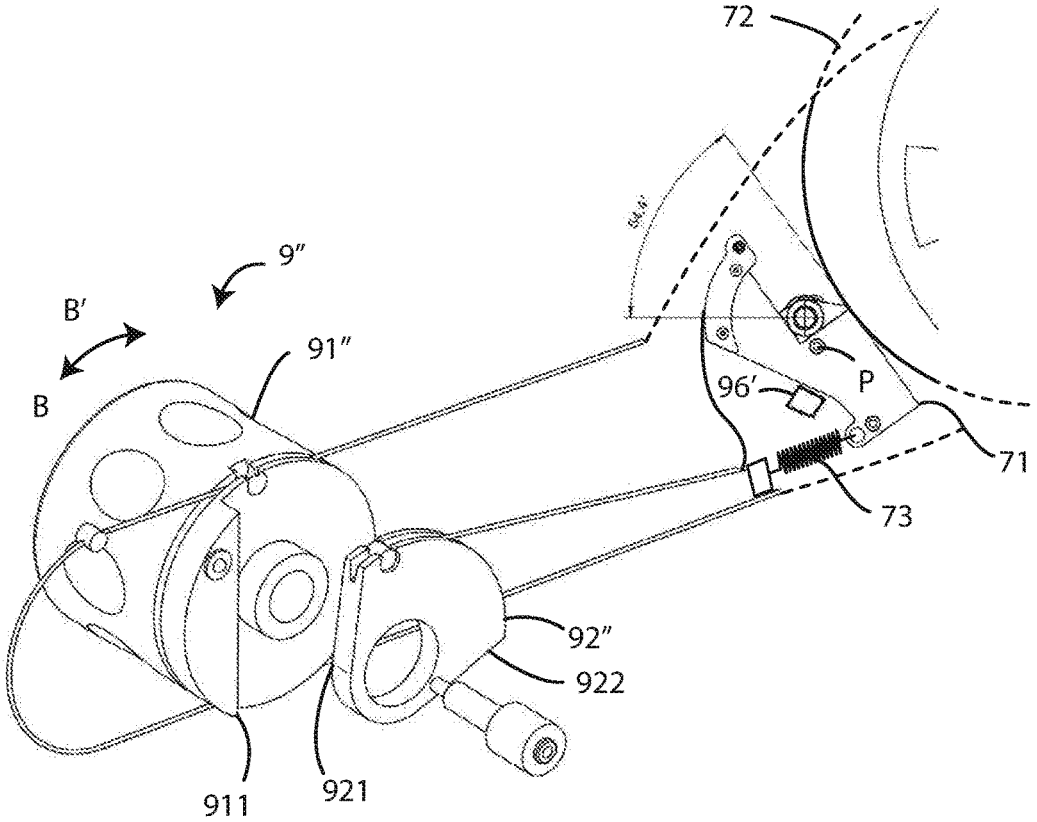
FIG. 19 shows an exploded view of a detail of FIG. 18.

Referring to FIGS. 12 and 13, in a first embodiment of said adjusting means 9, they comprise a first 91 and a second lever 92, separated from each other and independently controlled.

Said first lever 91 is connected, by means of transmission means, such as a cable or the like, with said first braking device 4, in particular with said air adjusting wheel 412, so as to change the overlap of the slots of said wheel 412 and of the slots of said cover 411 and thus changing the inflowing and the outflowing air flow rate from said first braking device 4, while said second lever 92 is connected by means of transmission means, such as a cable or the like, to said second braking device 7, 7', in particular to said second end of said bracket of said magnetic brake 71.

Said second braking device 7" and 7'" is powered by electrical wiring connected to said adjusting devices 9.

Alternatively, said first lever 91 can be arranged directly on said air adjusting wheel 412 and said second lever 92 can be fixed directly on said magnetic brake 71, 71'.

Said first 91 and second lever 92 are capable of rotating according to the clockwise rotation direction indicated by arrow A and the counterclockwise rotation direction indicated by arrow A'.

Referring to FIGS. 14-17, in a second embodiment, said adjusting means 9' comprise a first lever 91' and a second lever 92', coupled to each other.

In particular, said first lever 91' is connected by means of first transmission means, such as a cable or the like, with said first braking device 4, while said second lever 92' is connected by means of second transmission means, such as a cable and the like, to said second braking device 7, 7', in particular to said second end of said bracket of said magnetic brake 71.

Said first lever 91' is rotatably coupled with said elongated frame 2, in particular with said cross member 20, by means of a first pin 93 and it is capable of passing from a first position to a second position, by rotating according to the clockwise rotation direction represented by arrow A and then return from the second position to the first position by rotating counterclockwise.

On the surface of said first lever 91' a cavity 94 is obtained configured, for example, as a circumferential arc, having a rotation center coinciding with said first pin 93.

Said adjusting means 9' also comprise a second lever 92' rotatably coupled with said elongated frame 2, in particular with said cross member 20, by means of said first pivot 93, which is capable of passing from a first position to a second position, rotating according to said clockwise rotation direction indicated by arrow A and capable of returning from the second position to the first position by rotating in the counterclockwise direction.

Said second lever 92' is provided with an elongated end **92*a*', suitable to contact a stop block 96, fixed on said cross member 20**.

Said second lever 92' is integral with a second pin 95 arranged within said cavity 94.

FIGS. 18-22 show a third embodiment of said adjusting means 9", which differs from the second embodiment in that it comprises a knob 91" positioned on said elongated frame 2, particularly on the upper face of said cross member 20, and capable of rotating according to a rotation direction indicated by the arrow B and an opposite rotation direction indicated by arrow B'.

The knob 91" is connected by first transmission means, such as a cable or the like, to said first braking device 4 and it is provided on its lower face with a shoulder 911, which rotates from a first position to a second position, according to a rotation direction indicated by the arrow B and an opposite rotation direction indicated by the arrow B', whose function will be described in detail in the following.

Said adjusting means 9" also comprise a rotatable element 92", operably coupled with said knob 91", which is connected, by means of second transmission means, such as a cable and the like, with said second braking device 7, 7', in particular with said second end of said bracket of said magnetic brake 71.

Said rotatable element 92" has a first abutment surface 921 and a second abutment surface 922, interacting with said shoulder 911 during the rotation from a first position to a second position according to a rotation direction indicated by arrow B and an opposite direction indicated with the arrow B'.

In said third embodiment of said adjusting means 9", said stop block 96' is positioned close to said magnetic brake 71.

Said improved rowing machine 1 may also include a monitor or a display 10 for displaying training parameters.

In a further embodiment, said braking device can be automatically actuated by the user by means of actuators, for example of electromechanical type, actuated by acting on said monitor or display 10.

The operation of the improved rower 1 described above is as follows.

When a user intends to play one or more strokes on said improved rowing machine 1, he sits on said seat 3 and rests his feet on said pair of footrests 23. Said seat is initially in a rest position then positioned on said front 21.

Said user grips said handlebar 82 and starts to pull said chain 81, trying to overcome the resistance of said first braking device 4 by sliding said seat 3 from said front part 21 towards said rear part 22, by pushing with the legs and the feet on said footplates 23. At the same time the user pulls said handlebar 82 bending his arms.

Consequently, said chain 81 passes from said rest position, in which the user grips said handlebar 82 to start the stroke, to said working position, in which the user has carried out the whole stroke and said chain 81 has reached the end stroke.

At said rear part 22, the user releases said handlebar 82 and hence said chain 81, stretching arms and folding the legs, being the feet constrained at said footplates 23, so as to bring said seat 3 back to said front part 21.

As a result, said chain 81 returns towards said rest position by means of said elastic returning system 83.

In case of the user wishes to increase the physical effort made during the strokes, said second braking device 7, 7', 7" or 7'" can be actuated by means of said adjusting means 9, 9' or 9", in order to increase the resistance opposite to the motion of said actuating means 8 and, therefore, of the user, since said second braking device 7, 7', 7" or 7'" reduces the rotation inertia of said first braking device 4, when it is already moving.

According to the first embodiment of said adjusting means 9, the user may rotate said first lever 91, according to said clockwise rotation direction A to adjust the air flow through said air brake 41 by adjusting the overlapping of the slots of said wheel 412 with the slots of said cover 411 and thereby adjusting the passage of air through said slots.

The user may also rotate said second lever 92 according to said clockwise rotation direction A to actuate the additional resistance of said second braking device 7, 7', 7", 7'", in particular to activate said magnetic brake 71 and to adjust the overlap of said magnetic brake 71 with said disc 72.

The user may rotate anticlockwise both said first 91 and said second lever 92 to disengage respectively said first braking device 4 and said second braking device 7, 7', 7", 7'".

According to the second embodiment of said adjusting means 9', the user may act on said first lever 91' to adjust the air flow through said air brake 41, by adjusting the overlapping of the slots of said wheel 412 with the slots of said cover 411.

In particular, the user starts to push said first lever 91' according to said clockwise rotation direction A to move it from said first position, wherein said second pin 95 contacts a first end of said cavity 94.

When said first lever 91' is in said first position, said second lever 92' is also in a first position, where said elongated end **92*a*' abuts on said stop block 96**.

Continuing to push said first lever 91' according to said clockwise rotation direction A, said second end of said cavity 94 contacts said second pin 95 and said second lever 92' is still stationary in said first position.

Pushing further said first lever 91' according to said clockwise rotation direction A, said first lever 91' reaches said second position, for activating said second braking device 7, 7', 7", 7'", in which said second pin 95 is dragged into rotation by said first lever 91', remaining in contact with said second end of said cavity 94.

Then, said second pin 95 drags into rotation said second lever 92', which passes from said first position to said second position, wherein said elongated end **92*a*' moves away from said stop block 96 and said magnetic brake 71, 71' is activated by means of said connecting members, overcoming the resistance of said spring 73**.

To return said first 91' and second 92' levers to said first position, the user may rotate said first lever 91' according to said counterclockwise direction A', to disengage said first braking device 4.

Accordingly, said second lever 92' is carried by said first lever 91' in said first position by means of a rotational drag, according to said counterclockwise direction A'.

Said magnetic brake 71 returns to its original position as a result of the elastic return of said spring 73, thereby disabling said second braking device 7, 7', 7", 7'".

The operation of said adjusting means 9" according to the third embodiment is analogous to the operation of said adjusting means 9' according to the second embodiment.

Figure 20:
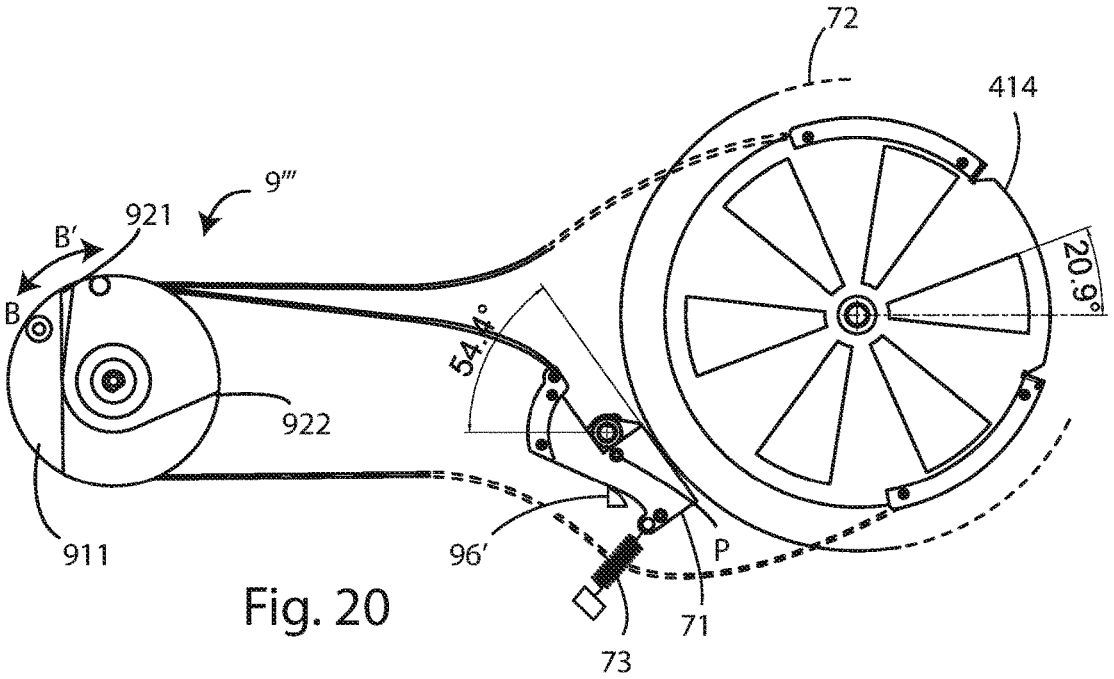
FIG. 20 shows a bottom schematic view of the third embodiment of the control device in a first control position.
Figure 21:
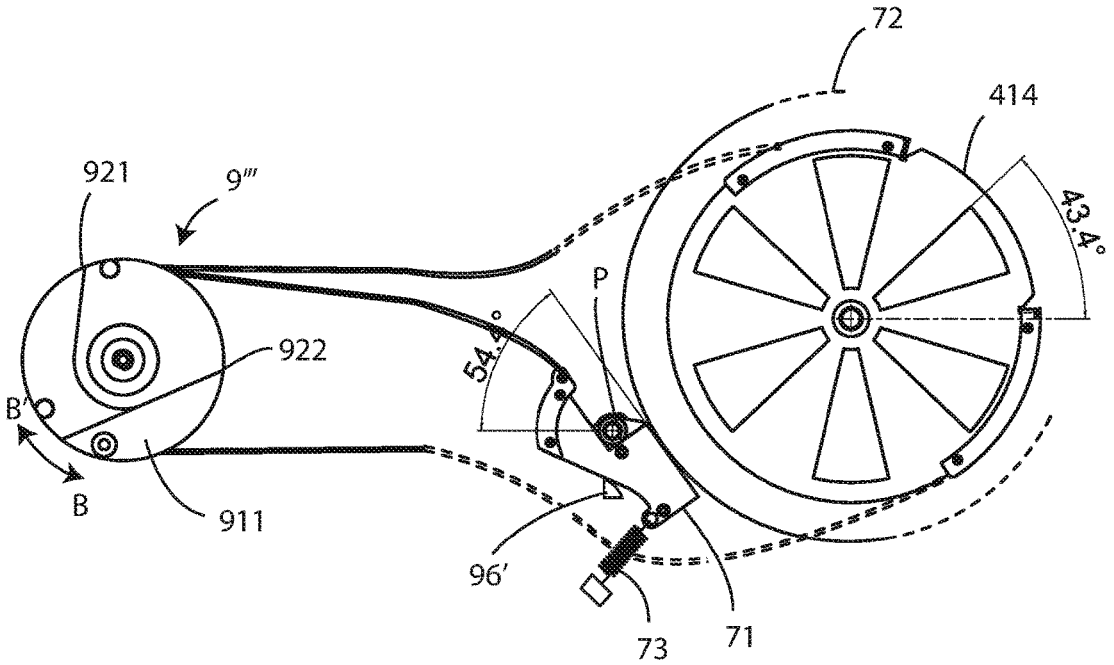
FIG. 21 shows a bottom schematic view of the third embodiment of the control device in a second control position.
Figure 22:
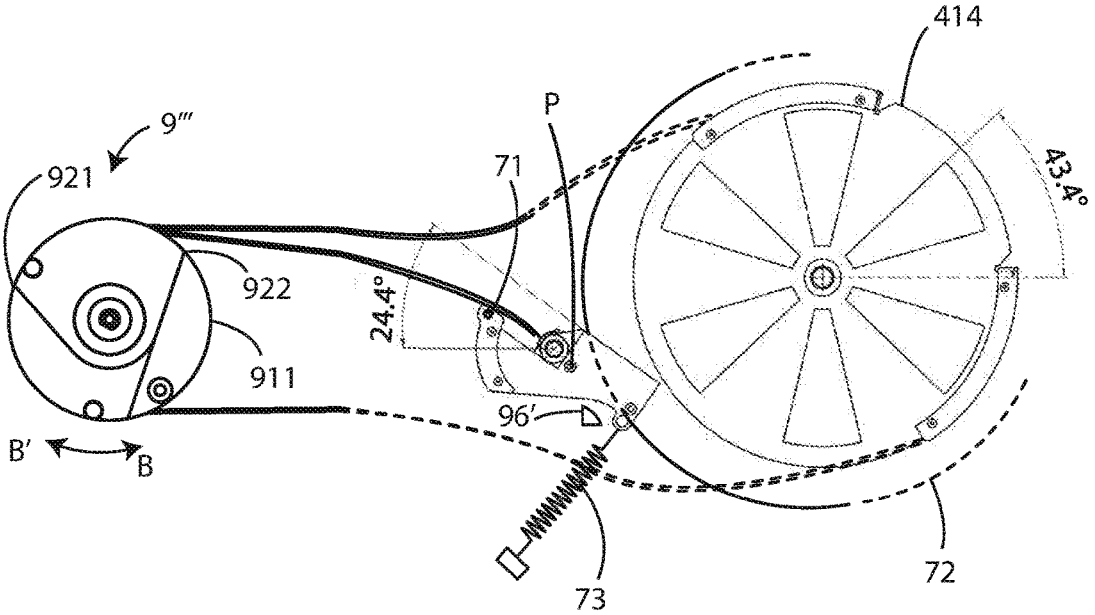
FIG. 22 shows a bottom schematic view of the third embodiment of the control device in a third control position.

In particular, referring to FIG. 20, the user can rotate said knob 91" according to said rotation direction indicated by the arrow B to adjust the air flow passing through said air brake 41, by adjusting the overlapping of the slots of said wheel 412 with the slots of said cover 411 and thereby adjusting the passage of the air through said slots.

Further, by continuing to rotate said knob 91' according to said rotation direction indicated by arrow B, said shoulder 911 moves from said first position, wherein said shoulder 911 is in contact with said first abutment surface 921 of said rotatable element 92", to an intermediate position, in which said shoulder 911 contacts with said second abutment surface 922.

Continuing to rotate said knob 91" according to said rotation direction B, said rotatable element 92" also rotates in said rotation direction B, thereby activating said magnetic brake 71 by means of said connecting members, which deviates from said stop block 96'.

At the same time, the spring 73 is energized.

To return said knob 91" and rotatable element 92' to said first position, the user can rotate said knob 91' according to said rotation direction indicated by the arrow B', to disable said first 4 and second 7, 7', 7", 7'" braking device.

Said magnetic brake 71 returns to its original position following the elastic return of said spring 73, thus disengaging said second braking device 7, 7', 7", 7'".

As it can be seen from the previous description, the improved rowing machine according to the present invention provides an air braking device and an additional braking device, which can be actuated independently of said air braking device.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A rowing machine, for the execution of gymnastic exercises, comprising:

an actuating device movable between a rest position and a working position, a first braking device, operatively connected to said actuating device and configured to brake a motion of said actuating device during a passage from said rest position to said working position, a second braking device operatively connected to said actuating device, said second braking device being configured to brake the motion of said actuating device during the passage from said rest position to said working position, said rowing machine further comprising an adjusting device to adjust said first and second braking device, wherein said adjusting device comprises a first member, arranged on an elongated frame of the machine, connected by a first transmission to said first braking device, said first member being capable of passing from a first position to a second position, and a second member, arranged on said elongated frame coupled to said first member, connected by a second transmission, to said second braking device, wherein said first member, moving from said first position to said second position, causes a rotation of said second member for activating said second braking device.

2. The rowing machine according to claim 1, wherein said first braking device is an air brake comprising a flywheel, capable of generating a braking force to a motion of said actuating device substantially proportional to the speed of rotation of said flywheel and in that said second braking device is suitable for generating a braking force capable to reduce the speed a rotation of said flywheel.

3. The rowing machine according to claim 2, wherein said second braking device is integral with said flywheel.

4. The rowing machine according to claim 1, wherein said second braking device comprises a disc rotating following the operation of said actuating device passing from said rest position to said working position, and braking magnetic members, capable to generate a magnetic braking force on said disc.

5. The rowing machine according to claim 1, wherein the elongated frame comprises a front part and a rear part, said elongated frame further comprising a cross member on which a track is arranged, and a support arm, placed in correspondence of said front part, and further comprises:

a seat, slidingly coupled to said track, for the seat of a user, so as to slide from said front part to said rear part and vice versa, a shaft arranged on said support arm, and in that said first braking device comprises a fixing plate, for the fixing to said shaft.

6. The rowing machine according to claim 5, wherein said shaft has a first and a second end, said first braking device being coupled to said first end of said shaft and said second braking device being coupled to said second end of said shaft.

7. The rowing machine according to claim 5, wherein an electromagnetic brake is coupled to said fixing plate.

8. The rowing machine according to claim 5, wherein said second braking device comprises an electromagnetic brake and said shaft has a first and a second end, said first braking device being coupled to said first end of said shaft and said second braking device being coupled to said second end of said shaft.

9. The rowing machine according to claim 1, wherein said second braking device comprises an electromagnetic brake.

10. The rowing machine according to claim 1, wherein the rowing machine further comprises a display for the interaction of a user with said rowing machine itself, and said first and second braking device are activated by a user through a remote device operable by said display.

11. The rowing machine according to claim 1, wherein said first member is a first lever connected to said first braking device or said first lever is arranged on said second braking device to activate said second braking device, and the second member is a second lever connected to said first braking device.

12. The rowing machine according to claim 1, wherein said first member is a first lever rotatably coupled with said elongated frame by a first pivot and first lever is capable to pass from a first position to a second position rotating according to a direction of rotation, wherein a cavity is formed on the surface of said first lever, said second member is a second lever rotatably coupled with said elongated frame by a first pin to pass from a first position to a second position by rotating according to said direction of rotation, said second lever is provided with an elongated end, and said second lever is integral with a second pin arranged in said cavity of said first lever.

13. The rowing machine according to claim 1, wherein said first member is a knob arranged on said elongated frame connected through the first transmission to said first braking device, and said second member is a rotatable element, rotatably coupled with said knob, connected through the second transmission to said second braking device.

14. The rowing machine according claim 13, wherein said knob comprises a shoulder rotating from a first position to a second position, and said rotatable element is provided with a first abutment surface and a second abutment surface, and in said first position, said shoulder is in contact with said first abutment surface and in said second position said shoulder is in contact with said second abutment surface.

* * * * *